US008022970B2

(12) United States Patent
Odagawa

(10) Patent No.: US 8,022,970 B2
(45) Date of Patent: Sep. 20, 2011

(54) IMAGE PROCESSING RESULT DISPLAY APPARATUS, IMAGE PROCESSING RESULT DISPLAY METHOD, AND PROGRAM FOR IMPLEMENTING THE METHOD

(75) Inventor: Masayuki Odagawa, Yokohama (JP)

(73) Assignee: Canon Kabushiki Kaisha (JP)

( * ) Notice: Subject to any disclaimer, the term of this patent is extended or adjusted under 35 U.S.C. 154(b) by 824 days.

(21) Appl. No.: 11/251,133

(22) Filed: Oct. 14, 2005

(65) Prior Publication Data

US 2006/0082600 A1 Apr. 20, 2006

(30) Foreign Application Priority Data

Oct. 14, 2004 (JP) ..... 2004-300254

(51) Int. Cl.
*G09G 5/00* (2006.01)

(52) U.S. Cl. ..... 345/684; 715/784; 375/240.12

(58) Field of Classification Search ..... 715/784–804; 345/501, 567, 684, 204, 472, 596, 201; 375/240.12
See application file for complete search history.

(56) References Cited

U.S. PATENT DOCUMENTS 6,317,129 B2 * 11/2001 Tomita ..... 345/467
6,867,801 B1 * 3/2005 Akasawa et al. ..... 348/222.1
2004/0135784 A1 * 7/2004 Cohen et al. ..... 345/501
2004/0217980 A1 * 11/2004 Radburn et al. ..... 345/672
2004/0255244 A1 * 12/2004 Filner et al. ..... 715/517
2005/0058353 A1 * 3/2005 Matsubara ..... 382/233
2007/0013708 A1 * 1/2007 Barcklay et al. ..... 345/557

FOREIGN PATENT DOCUMENTS

JP 2003-202855 A 7/2003
WO WO 2004021166 A1 * 3/2004

* cited by examiner

*Primary Examiner* — Kevin Nguyen
*Assistant Examiner* — Liliana Cerullo
(74) *Attorney, Agent, or Firm* — Rossi, Kimms & McDowell LLP

(57) ABSTRACT

An image processing result display apparatus that is capable of carrying out smooth scrolling. A scrolling direction that will be designated by an operator is predicted based on image data displayed on an LCD. Image data positioned in the predicted scrolling direction is pre-read from an external storage device. Image data is generated by carrying out predetermined image processing on the pre-read image data and is stored in a main memory. A portion of image data displayable on the LCD is read from the image data stored in the external storage device or in the main memory. If image data positioned in the scrolling direction designated by the operator is stored in the main memory, the image data is read from the main memory, and image data positioned in the scrolling direction designated by the operator is generated based on the read image data, and the generated image data is displayed on the LCD.

9 Claims, 12 Drawing Sheets

(EXAMPLE OF TEXT WRITTEN HORIZONTALLY)

(EXAMPLE OF TEXT WRITTEN VERTICALLY)

PRESENT
IMAGE AREA

COPY TO
NEW IMAGE AREA

ADD SCROLLING
PORTION

*FIG. 9A*

24-bit IMAGE FORMAT

| BYTE 0 | BYTE 1 | BYTE 2 | BYTE 3 |
|---|---|---|---|
| PIXEL 0 | | | PIXEL 1 |
| R(8 bits) | G(8 bits) | B(8 bits) | R(8 bits) |

| BYTE 0 | BYTE 1 | BYTE 2 | BYTE 3 |
|---|---|---|---|
| PIXEL 1 | | PIXEL 2 | |
| G(8 bits) | B(8 bits) | R(8 bits) | G(8 bits) |

| BYTE 0 | BYTE 1 | BYTE 2 | BYTE 3 |
|---|---|---|---|
| PIXEL 2 | | PIXEL 3 | |
| B(8 bits) | R(8 bits) | G(8 bits) | B(8 bits) |

*FIG. 9B*

8-bit IMAGE FORMAT

| BYTE 0 | | BYTE 1 | | BYTE 2 | | BYTE 3 | |
|---|---|---|---|---|---|---|---|
| PIXEL 0 | | PIXEL 1 | | PIXEL 2 | | PIXEL 3 | |
| R(3 bits) | G(3 bits) | B(2 bits) | R(3 bits) | G(3 bits) | B(2 bits) | R(3 bits) | G(3 bits) | B(2 bits) |

IMAGE PROCESSING RESULT DISPLAY APPARATUS, IMAGE PROCESSING RESULT DISPLAY METHOD, AND PROGRAM FOR IMPLEMENTING THE METHOD

BACKGROUND OF THE INVENTION

1. Field of the Invention

The present invention relates to an image processing result display apparatus, and an image processing result display method, that display results of image processing executed according to instructions from an operator on a display, and a program for implementing the method.

2. Description of the Related Art

Conventionally, in an image processing result display apparatus that displays image processing results, such as a copying machine, image data for display is generally compressed and stored in an internal memory or an external storage device connected to a PCI (Peripheral Component Interconnect) bus (for example, refer to Japanese Laid-Open Patent Publication (Kokai) No. 2003-202855).

FIG. 10 is a block diagram schematically showing the construction of a conventional image processing result display apparatus.

As shown in FIG. 10, the conventional image processing result display apparatus is comprised of a CPU 101 that controls the entire apparatus, a main memory 102 that temporarily stores various input information and arithmetic results, an LCD (Liquid Crystal Display) controller 103 that controls an LCD 107 to display image processing results on the LCD 107, a color reducing unit 106 that carries out color reduction, a zooming/scrolling unit 105, a JPEG (Joint Photographic Expert Group) decoder 104, a PCI bus controller 108, and an external storage device 110.

The CPU 101, the main memory 102, the LCD controller 103, the JPEG decoder 104, the zooming/scrolling unit 105, the color reducing unit 106, and the PCI bus controller 108 are connected together via a local bus 100. The PCI bus controller 108 and the external storage device 110 are connected together via a PCI bus 109.

The LCD 107 displays image data having a resolution that is designated by the operator. The image data is generated from JPEG-compressed image data of, for example, four types of resolutions of 25 dpi (Dot per Inch), 50 dpi, 100 dpi, and 200 dpi, that are stored in the external storage device 110. Image data of each resolution are each divided into tiles of 32 pixels×32 pixels, and each tile is JPEG-compressed.

If the resolution of a display image is designated to be, for example, 150 dpi, the JPEG decoder 104 reads JPEG-compressed image data of tiles of an image data portion required for display from 100 dpi and 200 dpi JPEG-compressed image data that are stored in the external storage device 110. The JPEG decoder 104 then expands the read compressed image data and writes the expanded image data onto the main memory 102.

The zooming/scrolling unit 105 generates image data of 150 dpi from the expanded 100 dpi and 200 dpi image data and writes the generated 150 dpi image data onto the main memory 102. The image data generated and written to the main memory 102 in this manner is displayed on the LCD 107.

FIG. 11 a flowchart showing a zooming/scrolling process carried out by the above conventional image processing result display apparatus.

When a scroll operation is instructed while a 150 dpi zoom image is being displayed, the JPEG decoder 104 reads JPEG-compressed image data that should be added in the direction of scrolling, from the external storage device 110 (step S101), expands the read image data, and writes the expanded image data onto the main memory 102 (step S102). Next, the zooming/scrolling unit 105 generates zoom image data from the expanded image data and writes the generated zoom image data onto the main memory 102. The CPU 101 adds the generated image data to a portion of image data that is to be displayed even after scrolling, out of the image data currently being displayed, and writes the resulting image data as new image data onto the main memory 102 (step S103). The CPU 101 then gives an instruction to the color reducing unit 106 to carry out color reduction (step S104), and replaces the image data displayed on the LCD 107 by the newly generated image data (step S105). By this procedure, the display image appears to have been scrolled.

However, with the above conventional image processing result display apparatus, whenever scrolling is carried out, image data to be added is read from the storage device and then subjected to JPEG expansion/zooming. Due to this, processing takes a long time, and further, if the storage device is connected via a PCI bus or the like, it takes even a longer time to read data. Therefore, the scroll operation cannot follow instructions from the operator and thus it is not possible to carry out smooth scrolling.

SUMMARY OF THE INVENTION

It is an object of the present invention to provide an image processing result display apparatus and an image processing result display method, that are capable of carrying out smooth scrolling, and a program for implementing the method.

To attain the above object, in a first aspect of the present invention, there is provided an image processing result display apparatus comprising a first storage device that stores image data, an image processing device that carries out predetermined image processing on image data, a display device that displays image data processed by the image processing device on a display, a predicting device that predicts a scrolling direction that will be designated by an operator based on image data displayed on the display by the display device, a pre-reading device that pre-reads image data positioned in the scrolling direction predicted by the predicting device, from the first storage device, a second storage device that stores image data generated by carrying out the predetermined image processing by the image processing device on image data that is pre-read by the pre-reading device, a reading device that reads a portion of image data displayable by the display device from the image data stored in the first storage device or in the second storage device, and a scrolling device that is operable when image data positioned in the scrolling direction designated by the operator is stored in the second storage device, to cause the reading device to read the image data from the second storage device, generate image data positioned in the scrolling direction designated by the operator, based on the read image data, and causes the display device to display the generated image data.

Preferably, the image processing result display apparatus further comprises a determining device that is operable when text data is contained in the portion of image data read from the first storage device by the reading device, to determine a writing direction of text based on the text data, and the predicting device predicts the scrolling direction that will be designated by the operator, based on the writing direction of the text determined by the determining device.

More preferably, the determining device determines whether the writing direction of the text is a horizontal direction or a vertical direction, and the predicting device predicts that the operator will designate scrolling in the horizontal direction when it is determined by the determining device that the writing direction of the text is the horizontal direction, and predicts that the operator will designate scrolling in the vertical direction when it is determined by the determining device that the writing direction of the text is the vertical direction.

Preferably, the image processing result display apparatus further comprises a determining device that determines a display configuration when image data stored in the first storage device is displayed on the display, and the predicting device predicts the scrolling direction that will be designated by the operator, based on the display configuration of the displayed image data determined by the determining device.

More preferably, the determining device determines whether the display configuration is a horizontally elongated configuration or a vertically elongated configuration, and the predicting device predicts that the operator will designate scrolling in a horizontal direction when it is determined by the determining device that the image data has a horizontally elongated configuration, and predicts that the operator will designate scrolling in a vertical direction when it is determined by the determining device that the image data has a vertically elongated configuration.

Preferably, the second storage device has a faster image data reading speed than that of the first storage device.

Preferably, the first storage device stores compressed image data and the image processing device carries out expansion as the predetermined image processing on the compressed image data pre-read from the first storage device.

To attain the above object, in a second aspect of the present invention, there is provided an image processing result display method comprising an image processing step of carrying out predetermined image processing on image data, a display step of displaying image data processed in the image processing step on a display, a predicting step of predicting a scrolling direction that will be designated by an operator based on image data displayed on the display in the display step, a pre-reading step of pre-reading image data positioned in the scrolling direction predicted in the predicting step, from a first storage device that stores image data, a storage step of storing image data generated by carrying out the predetermined image processing in the image processing step on image data that is pre-read in the pre-reading step, in a second storage device, a reading step of reading a portion of image data displayable on the display in the display step from the image data stored in the first storage device or in the second storage device, and a scrolling step of causing the reading step to read the image data from the second storage device, generating image data positioned in the scrolling direction designated by the operator, based on the read image data, and causing the display step to display the generated image data on the display, when image data positioned in the scrolling direction designated by the operator is stored in the second storage device.

To attain the above object, in a third aspect of the present invention, there is provided a program for implementing the image processing result display method comprising an image processing step of carrying out predetermined image processing on image data, a display step of displaying image data processed in the image processing step on a display, a predicting step of predicting a scrolling direction that will be designated by an operator based on image data displayed on the display in the display step, a pre-reading step of pre-reading image data positioned in the scrolling direction predicted in the predicting step, from a first storage device that stores image data, a storage step of storing image data generated by carrying out the predetermined image processing in the image processing step on image data that is pre-read in the pre-reading step, in a second storage device, a reading step of reading a portion of image data displayable on the display in the display step from the image data stored in the first storage device or in the second storage device, and a scrolling step of causing the reading step to read the image data from the second storage device, generating image data positioned in the scrolling direction designated by the operator, based on the read image data, and causing the display step to display the generated image data on the display, when image data positioned in the scrolling direction designated by the operator is stored in the second storage device.

The above and other objects, features, and advantages of the present invention will become more apparent from the following detailed description taken in conjunction with the accompanying drawings.

BRIEF DESCRIPTION OF THE DRAWINGS

FIG. 9A is a diagram showing an example of an image data format before color reduction;

FIG. 9B is a diagram showing an example of an image data format after color reduction;

DETAILED DESCRIPTION OF THE PREFERRED EMBODIMENTS

The present invention will now be described in detail with reference to the drawings showing a preferred embodiment thereof.

Figure 1:
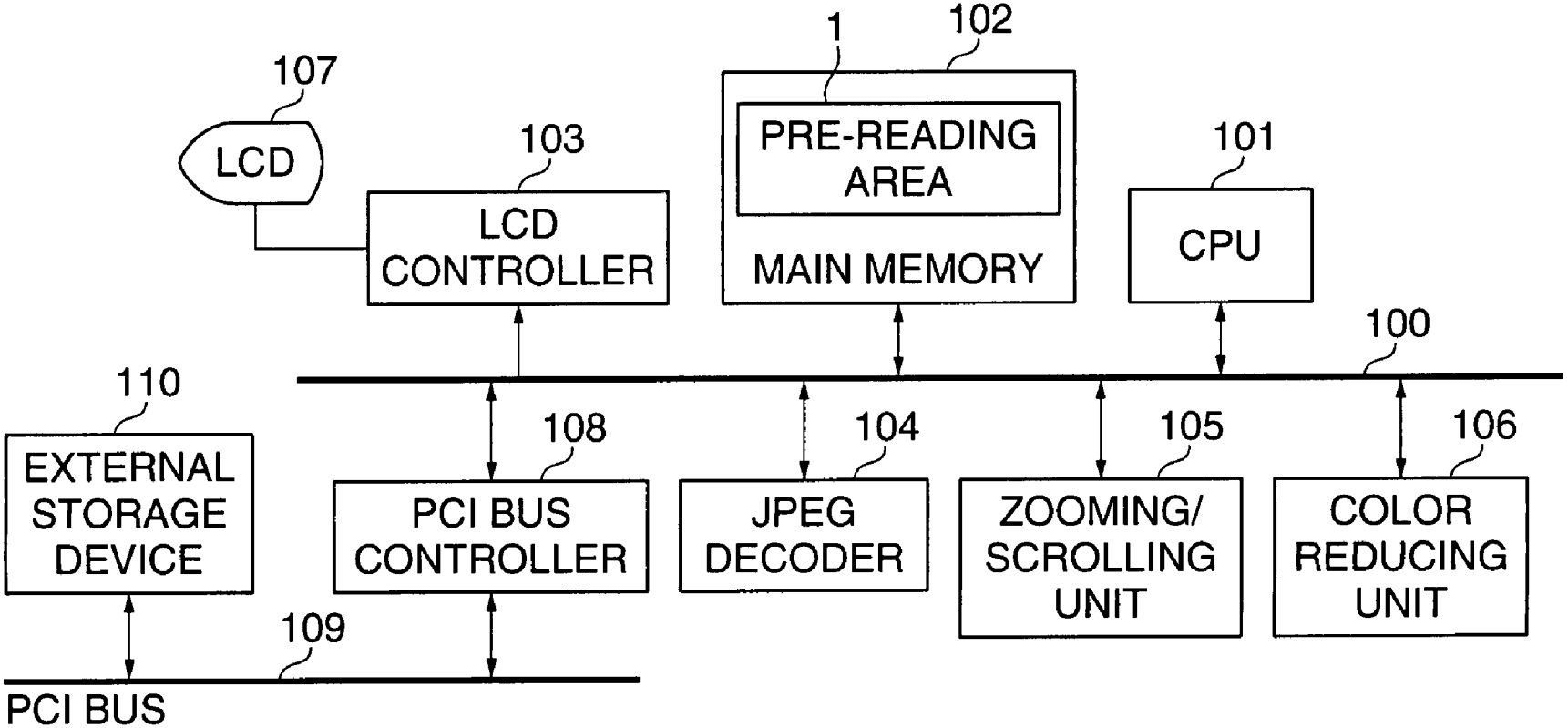
FIG. 1 is a block diagram schematically showing the construction of an image processing result display apparatus according to an embodiment of the present invention.
Figure 10:
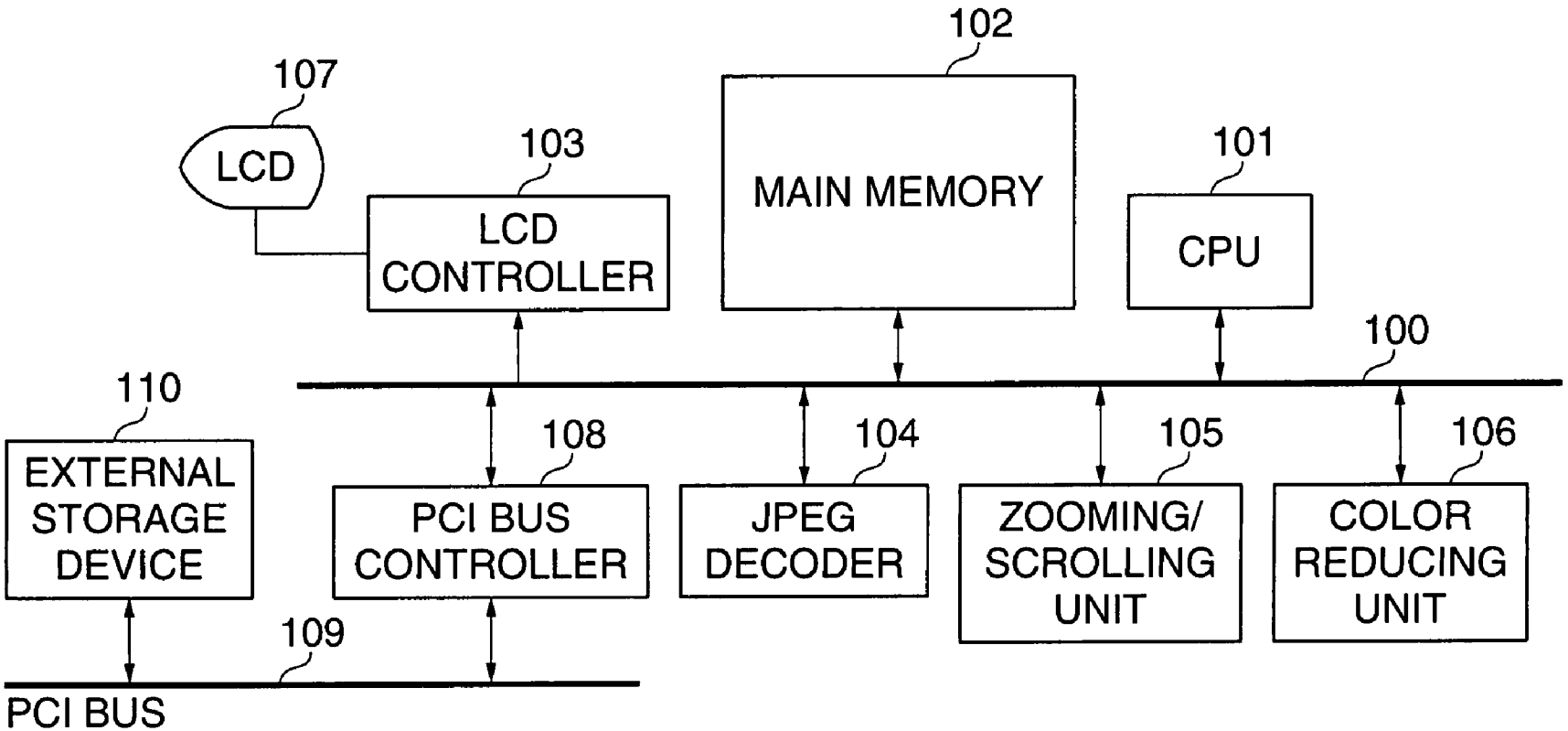
FIG. 10 PRIOR ART
FIG. 10 is a block diagram schematically showing the construction of a conventional image processing result display apparatus.

FIG. 1 is a block diagram schematically showing the construction of an image processing result display apparatus according to an embodiment of the present invention. In terms of hardware, the image processing result display apparatus according to the present embodiment differs from the aforedescribed conventional image processing result display apparatus only in the manner of use of a main memory 102. Therefore, the hardware construction of the aforedescribed conventional image processing result display apparatus, that is, the hardware shown in FIG. 10, is applied as it is to the image processing result display apparatus according to the present invention. It goes without saying, however, that even with the same hardware, the image processing result display apparatus according to the present invention uses different control processing from that of the conventional image processing result display apparatus.

Referring to FIG. 1, a CPU 101 accepts instructions from an operator and gives instructions to each processing unit.

The main memory 102 stores data required for displaying image processing results.

A JPEG decoder 104 is used for expanding JPEG-compressed image data that is stored in an external storage device 110.

A zooming/scrolling unit 105 generates image data having a resolution designated by the operator, and carries out image scrolling, etc.

A color reducing unit 106 carries out color reduction by, for example, the random dither method.

The external storage device 110 stores JPEG-compressed image data.

In the present embodiment, an LCD 107 is implemented by a color display of 8-bit inputs.

Figure 2:
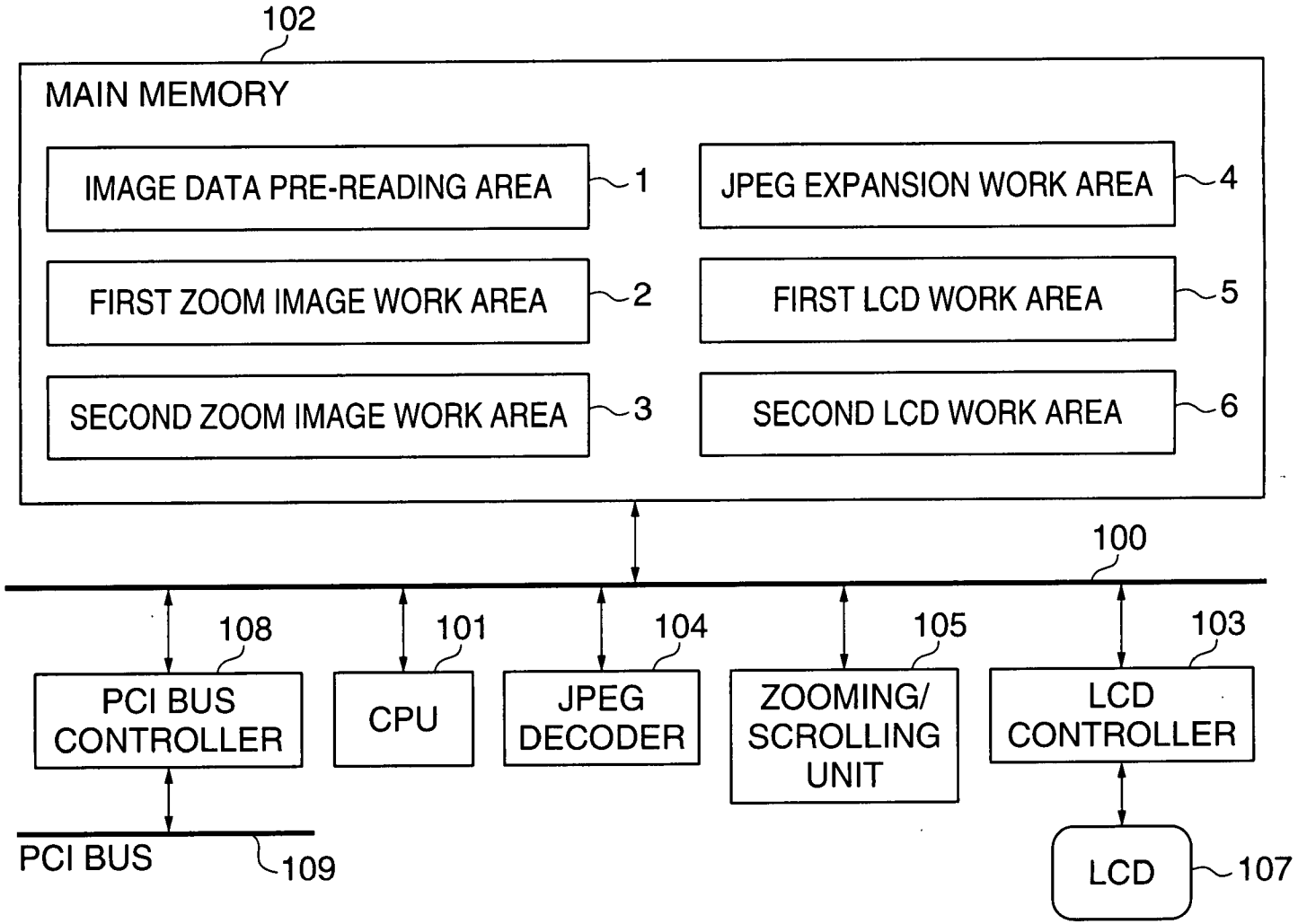
FIG. 2 is a block diagram showing areas reserved in a main memory appearing in FIG. 1, for storing various image data.

FIG. 2 is a block diagram showing areas reserved in the main memory 102 for storing various image data.

As shown in FIG. 2, the main memory 102 is comprised of an image data pre-reading area 1 for storing pre-read image data, and first and second zoom image work areas 2 and 3 for storing zoom image data generated by the zooming/scrolling unit 105. Further, the main memory 102 is comprised of a JPEG expansion work area 4 for storing image data expanded by the JPEG decoder 104, and first and second LCD work areas 5 and 6 for storing image data to be used for LCD displaying.

Figure 3:
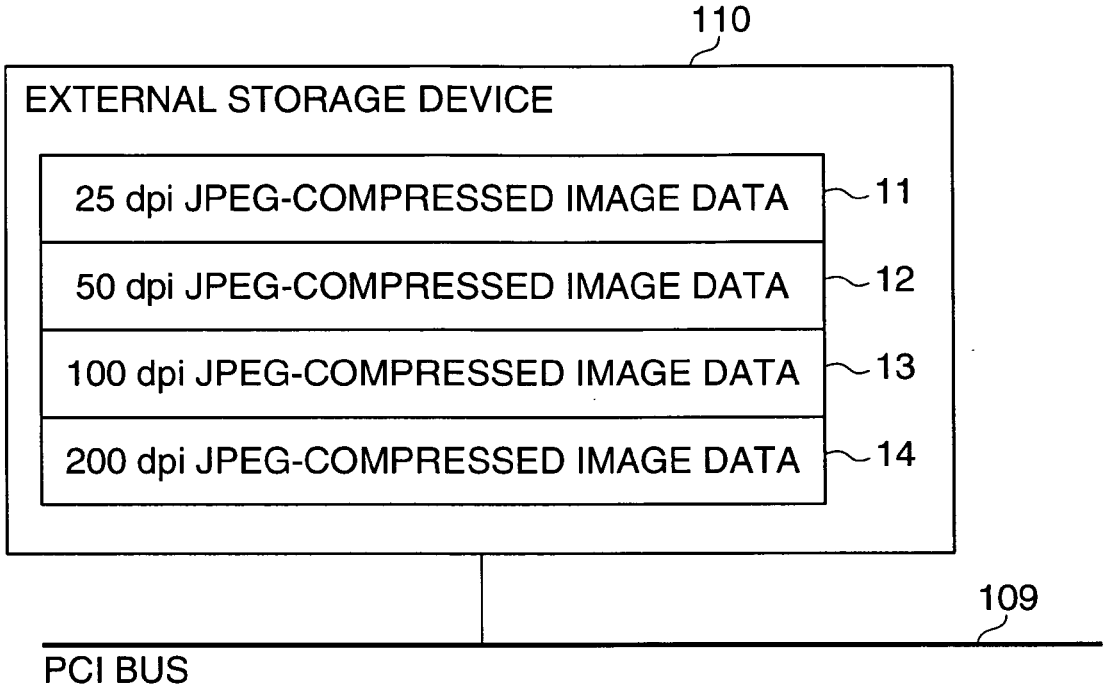
FIG. 3 is a block diagram showing types of image data that are stored in an external storage device appearing in FIG. 1.

FIG. 3 is a block diagram showing types of image data that are stored in the external storage device 110.

As shown in FIG. 3, the external storage device 110 stores image data of four types of resolutions, i.e., 25 dpi, 50 dpi, 100 dpi, and 200 dpi. Image data of each resolution are each divided into tiles of 32 pixels×32 pixels, and each tile is JPEG-compressed.

Figure 4:
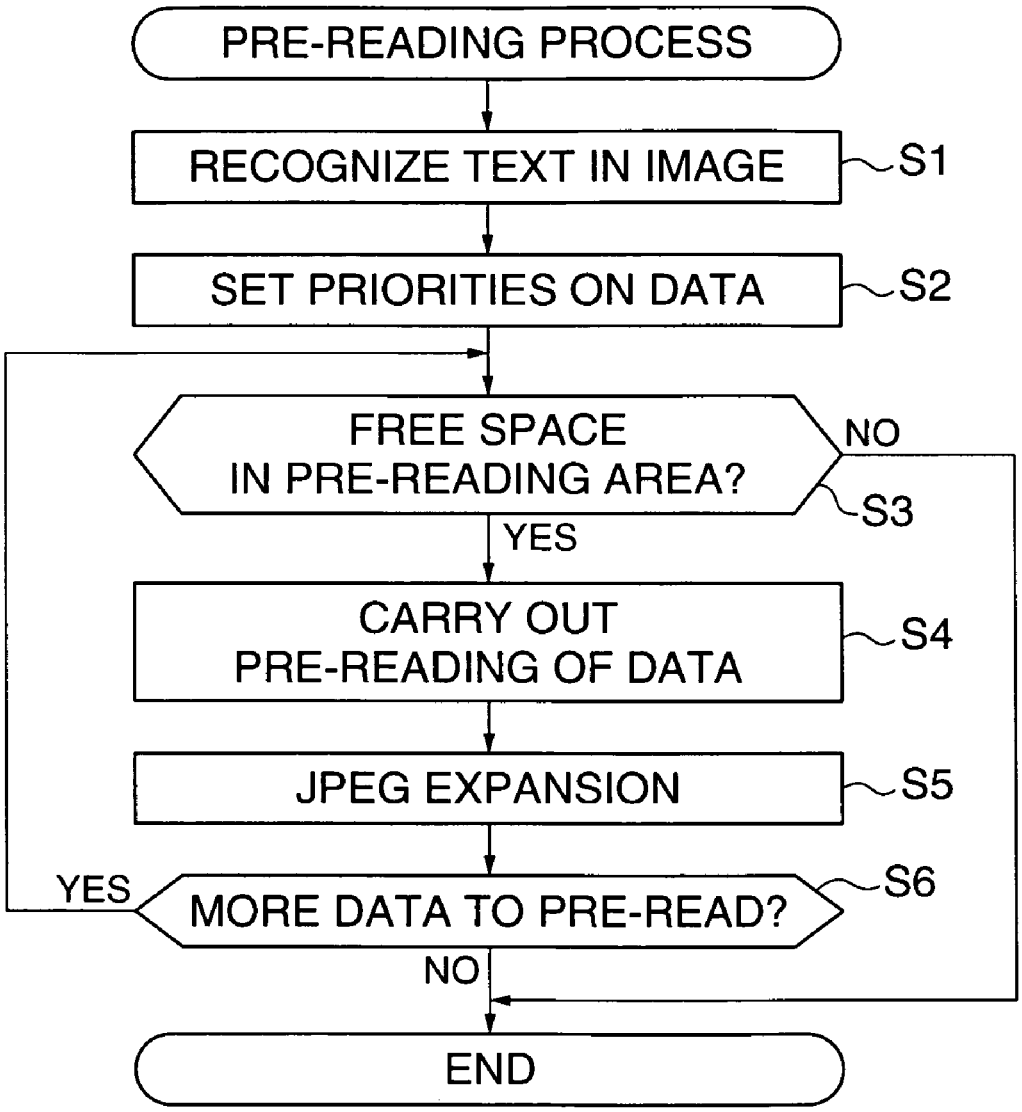
FIG. 4 is a flowchart showing a pre-reading process for pre-reading or reading in advance image data that is carried out by the image processing result display apparatus of FIG. 1, in particular by the CPU.

FIG. 4 is a flowchart showing a pre-reading process for pre-reading image data that is carried out by the image processing result display apparatus of the present embodiment, in particular by the CPU 101.

When a zoom image is displayed on the LCD 107, the CPU 101 determines whether or not text data is contained in the image data corresponding to the displayed zoom image, that is, in the image data stored in the first zoom image work area 2. If it is determined that text data is contained in the corresponding image data, the CPU 101 determines the writing direction of the text (step S1). Here, the writing direction of the text refers to whether the arrangement of character data constituting the text data is in a vertical direction (written vertically) or is in a horizontal direction (written horizontally). The reason why the writing direction is determined is that when assigning a priority order to image data to be pre-read, as described later, the priority order is assigned based on the writing direction of the text data contained in the image data.

The CPU 101 assigns a priority order to image data of two types of resolutions stored in the external storage device 110 that are required for displaying an image on the LCD 107 (step S2). Here, if the text is written horizontally, the operator tends to determine the contents of the text by scrolling in the horizontal direction, whereas if the text is written vertically, the operator tends to determine the contents of the text by scrolling in the vertical direction. Thus, the priority order of the image data to be pre-read is determined based on this fact.

Figure 5:
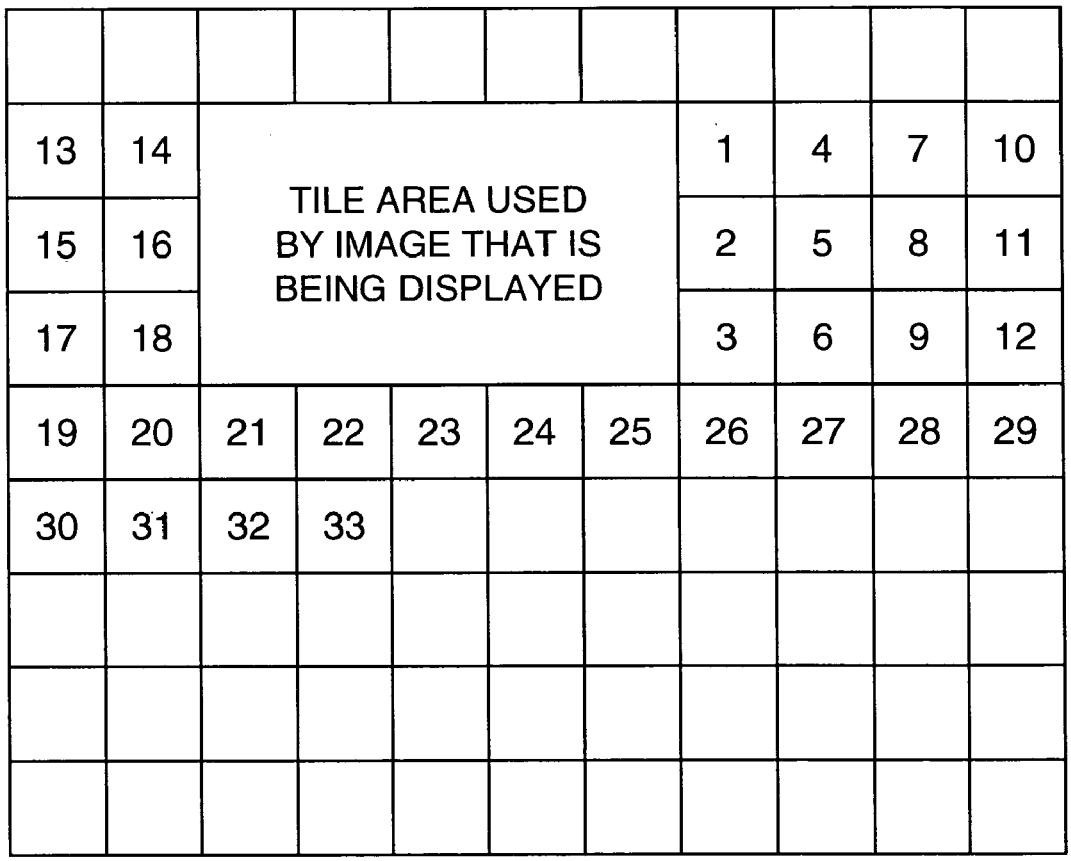
FIG. 5 is a diagram useful in explaining a method of determining an order of priority of image tiles that are to be pre-read, if a text is written horizontally.

Specifically, if the text is written horizontally, the priority order of the image data (image tiles) to be pre-read is determined as shown in FIG. 5. That is, image tiles that are adjacent to the right-hand side of the area that is being displayed on the LCD 107 are numbered or given priority levels from top to bottom, then moving rightwards. The image tiles are numbered in this manner until the right edge of the whole image tiles is reached (image tile numbered "12" in the example shown), then the numbering is carried out starting with the left edge of the whole image tiles (image tile numbered "13" in the example shown) where the image tiles are numbered from left to right, then moving downwards. Then, after the image tiles on the left-hand side of the area that is being displayed on the LCD 107 have been numbered, image tiles positioned one row under the area that is being displayed are numbered from the left edge to the right edge of the whole image tiles, and the numbering continues downwards.

Figure 6:
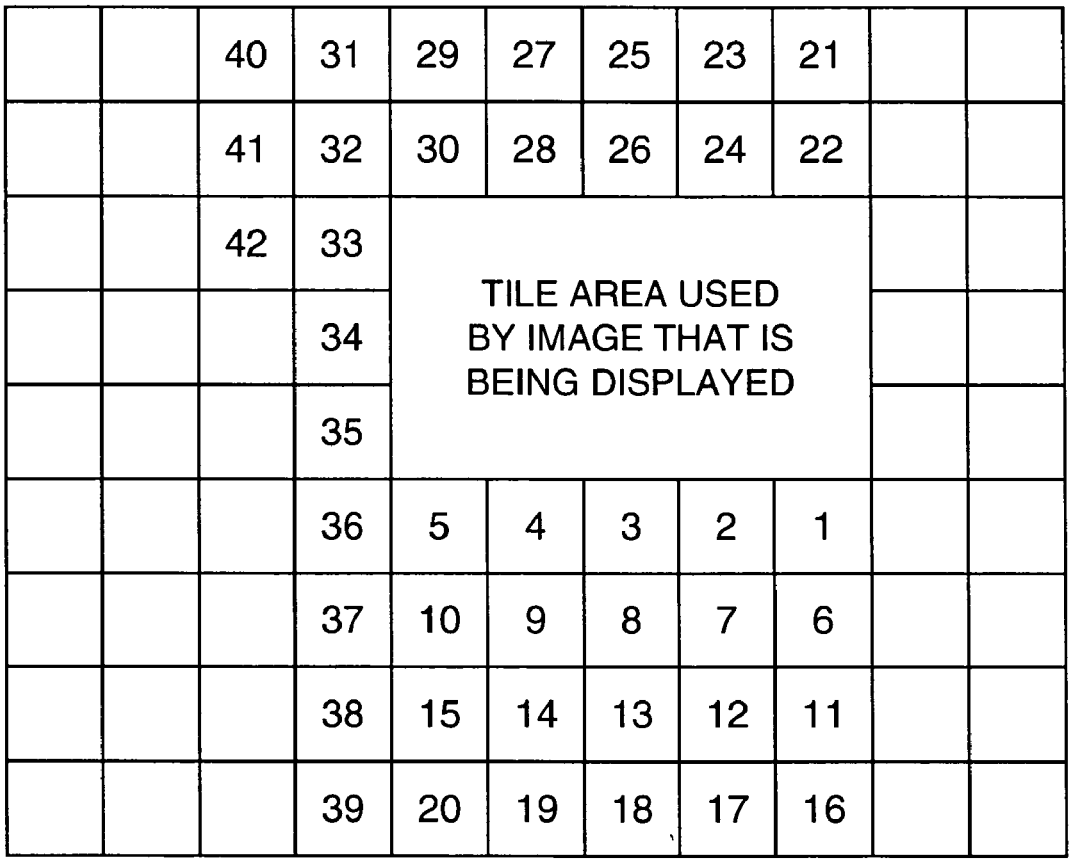
FIG. 6 is a diagram useful in explaining a method of determining an order of priority of image tiles that are to be pre-read, if a text is written vertically.

On the other hand, if the text is written vertically, the priority order of the image tiles to be pre-read is determined as shown in FIG. 6. That is, image tiles that are adjacent to the bottom side of the area that is being displayed on the LCD 107 are numbered from right to left, then moving downwards. The image tiles are numbered in this manner until the bottom edge of the whole image tiles is reached (image tile numbered "20" in the example shown), then the numbering is carried out starting with the upper edge of the whole image titles (image tile numbered "21" in the example shown) where the image tiles are numbered from right to left, then moving downwards. Then, after the image tiles on the upper side of the area that is being displayed on the LCD 107 have been numbered, image tiles positioned one column left of the area that is being displayed are numbered from the top edge to the bottom edge of the whole image tiles, and the numbering is continued leftwards.

Referring again to FIG. 4, after the numbering of the priority order of image tiles is completed, the CPU 101 causes the JPEG decoder 104 to carry out pre-reading of image data (image tiles). The CPU 101 determines whether or not there is a free space in the image data pre-reading area 1 (step S3). If there is a free space, the CPU 101 instructs the JPEG decoder 104 to sequentially read image tiles in descending priority order (step S4) and perform JPEG expansion on the read image tiles (step S5). The image data that has been expanded by the JPEG 104 decoder is written onto the image data pre-reading area 1. If the image data being displayed on the LCD 107 has a resolution of, for example, 150 dpi, the CPU 101 causes the JPEG decoder 104 to pre-read image data of two types of resolutions, i.e. of 200 dpi and 100 dpi.

The CPU 101 continues the pre-reading operation while no change arises in the operation carried out on the image data being displayed on the LCD 107, such as change of zooming rate or scrolling, as long as there is a free space in the image data pre-reading area 1 and there remains image data that can be pre-read (step S6).

Figure 7A:
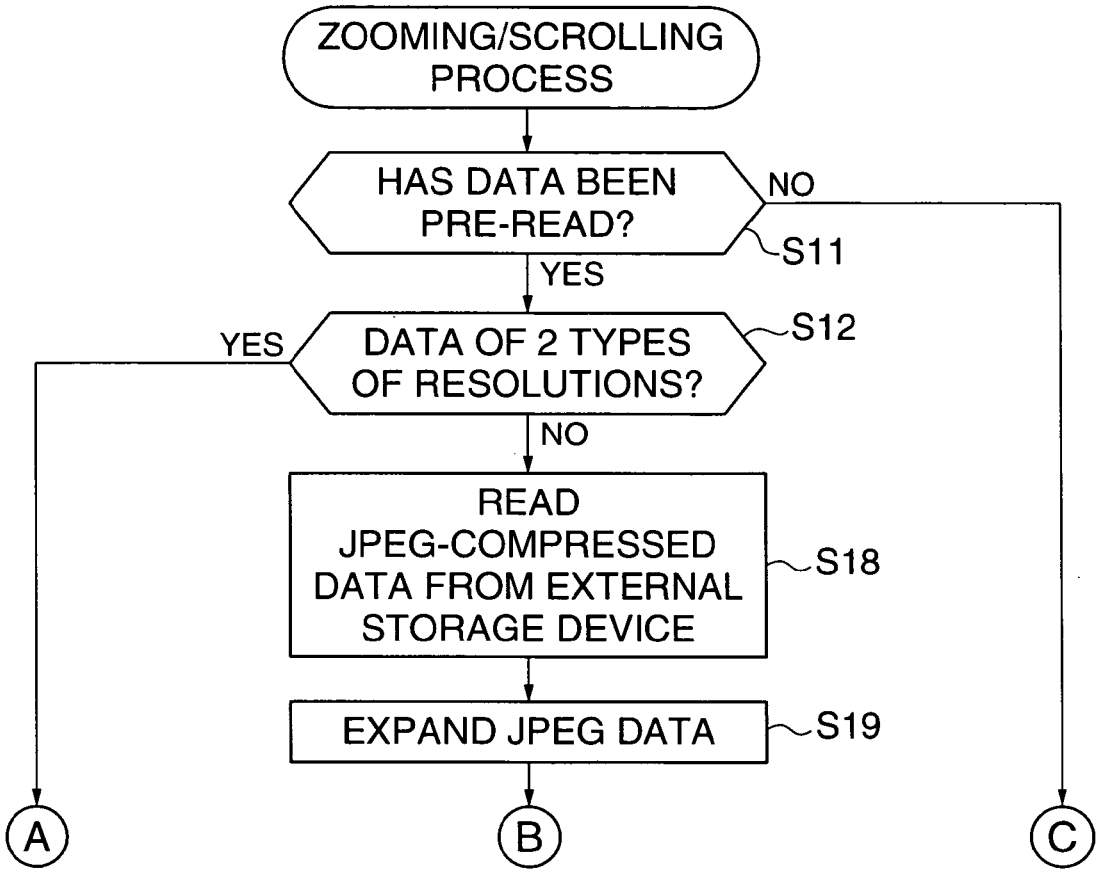
FIGS. 7A and 7B are flowcharts showing a zooming/scrolling process for zooming/scrolling image data that is carried out by the image processing result display apparatus of FIG. 1, in particular by the CPU.
Figure 7B:
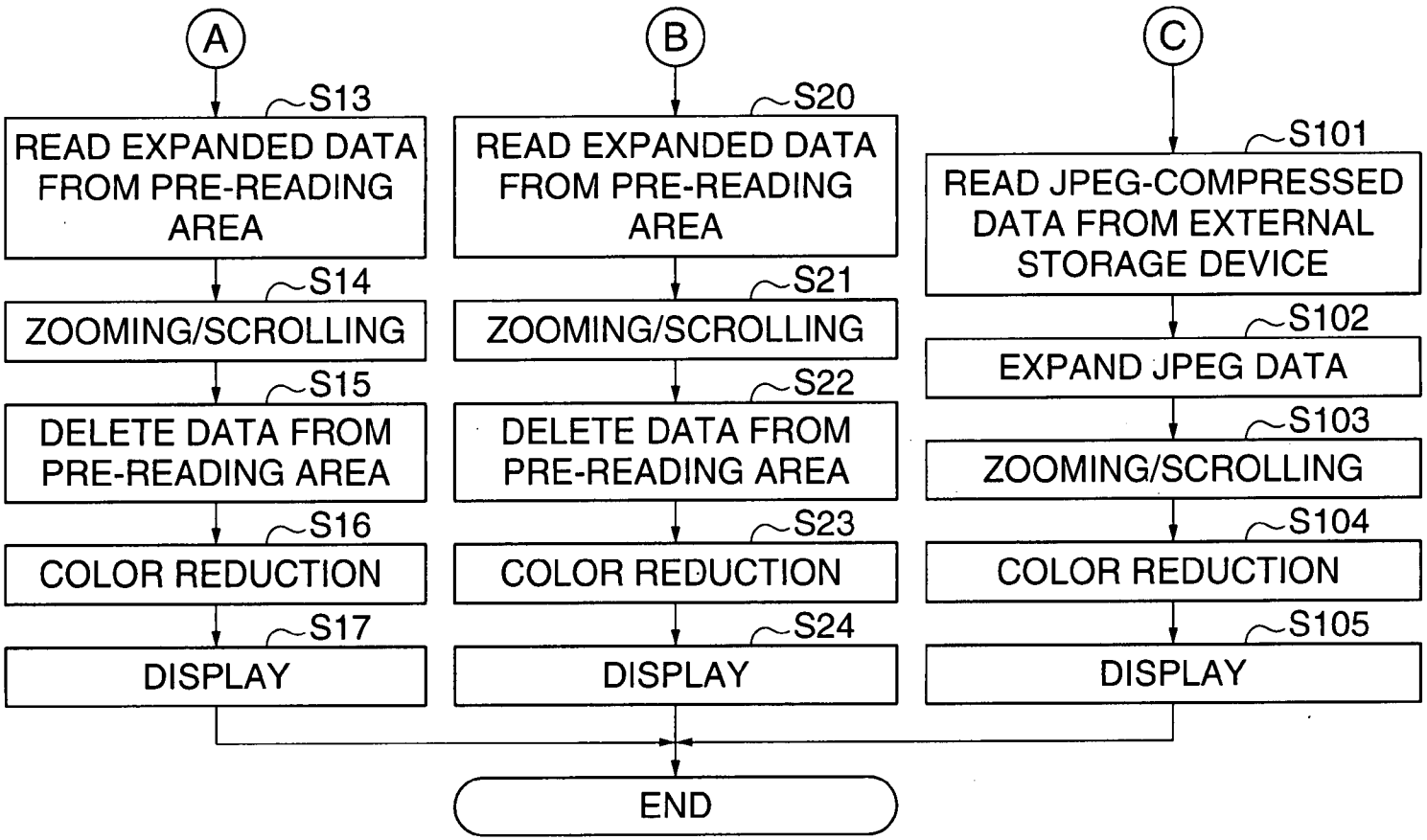
Figure 8:
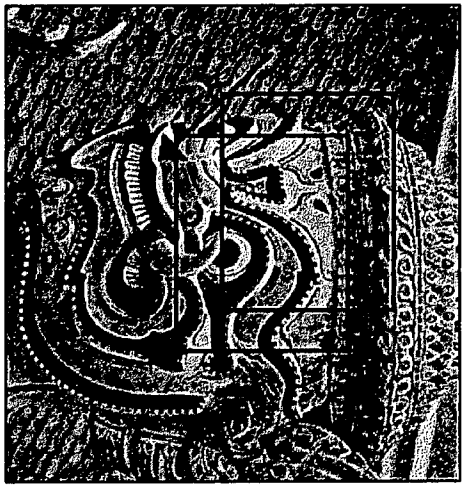
FIG. 8 is a view useful in explaining a method of scrolling.
Figure 8:
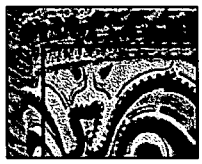
Figure 8:
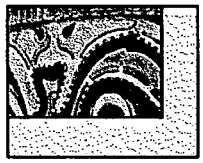
Figure 8:
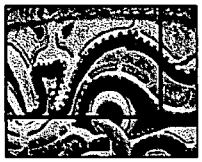

Next, a description will be given of a scrolling operation carried out using the pre-read image data with reference to flowcharts of FIGS. 7A and 7B as well as to FIG. 8.

When receiving an instruction from the operator to start a scrolling process, the CPU 101 copies a portion of image data that is still to be displayed on the LCD 107 after scrolling, from the image data stored in the first zoom image work area 2, to the second zoom image work area 3.

Next, the CPU 101 determines whether or not image data has been pre-read into the image data pre-reading area 1 (step S11). Here, if the portion of image data required for displaying the scrolling process on the LCD 107 is stored in the image data pre-reading area 1 of the main memory 102, then it is determined that the image data has been pre-read.

If it is determined in the step S11 that the image data has been pre-read, it is determined whether or not the pre-read image data is data of two types of resolutions (step S12). The reason why it is determined in this step whether or not image data of two types of resolutions have been pre-read is that the present embodiment is based on the premise that the zooming/scrolling unit 105 uses data of two types of resolutions (100 dpi and 200 dpi) to generate an image having the resolution (150 dpi) with which the image is being displayed on the LCD 107. Therefore, if only image data of one type of resolution has been pre-read, image data of another type of resolution must be read from the external storage device 110. That is, depending upon whether image data of one type of resolution or image data of two types of resolutions have been pre-read, the processing must be changed. If neither of image data of two types of resolutions is stored, it is determined that pre-reading of data has not been carried out.

If two types of data, i.e. 100 dpi and 200 dpi, are stored in the image data pre-reading area 1, the CPU 101 causes the zooming/scrolling unit 105 to generate image data of 150 dpi from the 100 dpi data and 200 dpi data in the image data pre-reading area 1 (step S13). Then, the zooming/scrolling unit 105 adds the generated 150 dpi image data to the second zoom image work area 3 to generate scrolled image data (step S14).

Next, after deleting the image data in the image data pre-reading area 1 (step S15), the CPU 101 instructs the color reducing unit 106 to carry out color reduction (step S16). The color reducing unit 106 reads image data from the second zoom image work area 3, carries-out color reduction on the read image data, writes the processed image data onto the first LCD work area 5, and generates an image to be displayed on the LCD 107.

FIGS. 9A and 9B are diagrams showing examples of image data formats. FIG. 9A shows an example of an image format before color reduction, and FIG. 9B shows an example of an image format after color reduction.

As shown in FIG. 9A, the image before color reduction is a 24-bit image composed of eight bits for each of R, G and B. When color reduction is carried out by the color reducing unit 106, an 8-bit image is generated, which is composed of R: 3 bits, G: 3 bits, and B: 2 bits, as shown in FIG. 9B.

Referring again to FIGS. 7A and 7B, the LCD controller 103 reads image data that has been reduced in color from the first LCD work area 5 and displays an image on the LCD 107 (step S17).

On the other hand, if it is determined in the step S12 that image data of only one type of resolution for example, 200 dpi, has been pre-read, the CPU 101 causes the JPEG decoder 104 to read 100 dpi JPEG-compressed image data from the external storage device 110 (step S18). The JPEG decoder 104 expands the 100 dpi JPEG-compressed image data and writes the expanded JPEG-compressed image data onto the JPEG expansion work area 4 (step 19).

Next, the CPU 101 causes the zooming/scrolling unit 105 to generate image data of 150 dpi from the 200 dpi expanded image data in the image data pre-reading area 1 and the 100 dpi expanded image data in the JPEG expansion work area 4 (step S20). Then, the zooming/scrolling unit 105 adds the generated 150 dpi image data to the second zoom image working area 3 to generate a scrolled image (step S21).

Next, after deleting the image data in the image data pre-reading area 1 (step S22), the CPU 101 instructs the color reducing unit 106 to carry out color reduction (step S23). The color reducing unit 106 reads image data from the second zoom image working area 3, carries out color reduction on the read image data, writes the processed image data onto the first LCD work area 5, and generates an image to be displayed on the LCD 107.

The LCD controller 103 reads image data that has been reduced in color from the first LCD work area 5 and displays an image on the LCD 107 (step S24).

Figure 11:
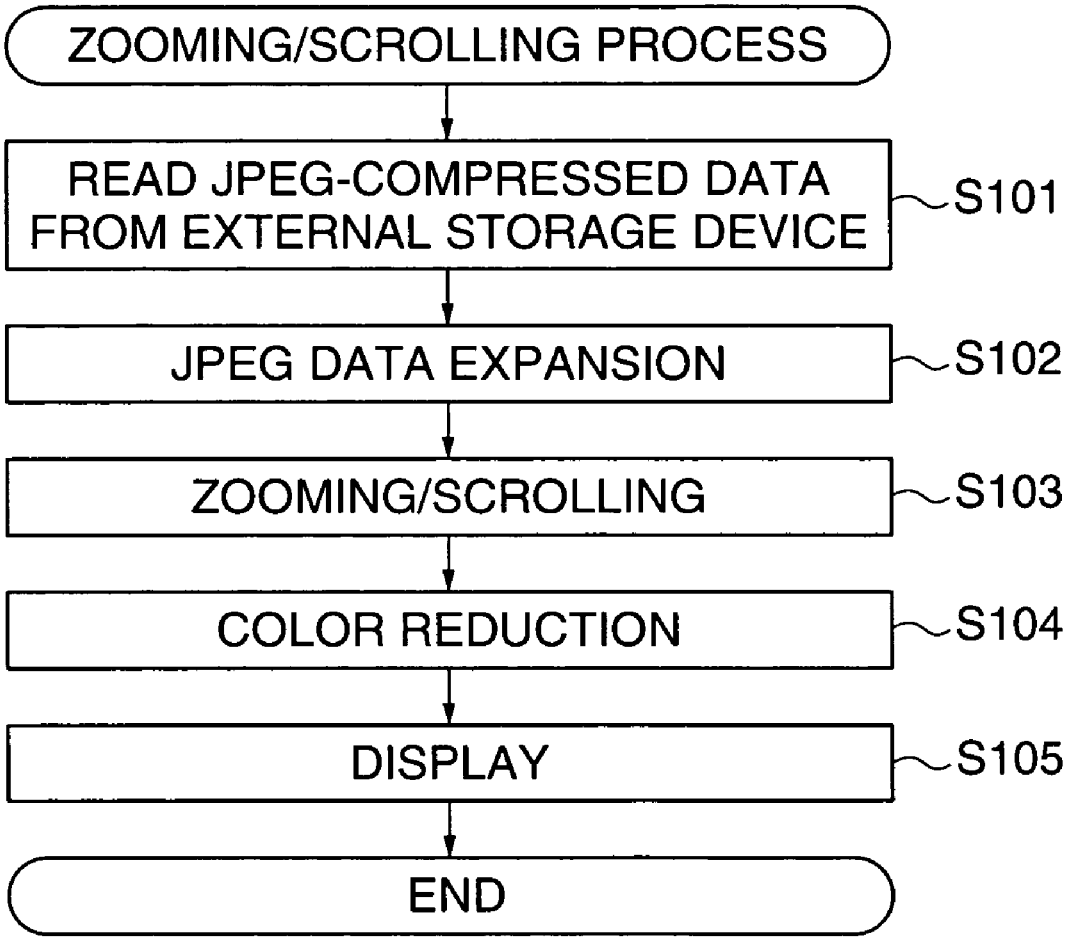
FIG. 11 PRIOR ART
FIG. 11 is a flowchart showing a zooming/scrolling process carried out by the conventional image processing result display apparatus.

On the other hand, if it is determined in the step S11 that no image data has been pre-read into the image data pre-reading area 1, a process that is the same as that of the conventional image processing result display apparatus, that is, the process described in the flowchart of FIG. 11 is carried out, and description thereof is omitted.

As described above, according to the present embodiment, pre-reading of image data is carried out by predicting the scrolling direction based on the writing direction of the text in the displayed image. Specifically, if the text in the displayed image data is written vertically, pre-reading is carried out giving priority to image data that is in the Y-direction of the displayed image data, whereas if the text in the displayed image is written horizontally, pre-reading is carried out giving priority to image data that is in the X-direction of the displayed image data. In a scrolling operation by the operator, there is a high possibility that the scrolling direction is determined according to the direction in which the text is written. Therefore, the possibility that the pre-read image data is used is high and thus it becomes possible to carry out smooth scrolling.

In the present embodiment, the scrolling direction is predicted based on the direction in which the text in the displayed image data is written. However, prediction of the scrolling direction is not limited to this and may be carried out by determining a display configuration or layout of the whole image data to be displayed when it is displayed, and predicting the scrolling direction based on the display configuration. Specifically, it is determined whether the display configuration of the whole image is a horizontally elongated configuration or is a vertically elongated configuration. If it is a horizontally elongated configuration, it is predicted that the scrolling direction is the same direction as in the case where the text is written horizontally, whereas if it is a vertically elongated configuration, it is predicted that the scrolling direction is the same direction as in the case that the text is written vertically. After the scrolling direction is predicted, the same processing as that in the present embodiment described above can be carried out, and description thereof is, therefore, omitted.

It is to be understood that the object of the present invention may be accomplished by supplying a system or an apparatus with a storage medium in which a program code of software which realizes the functions of the above described embodiment is stored, and causing a computer (or a CPU or an MPU) of the system or the apparatus to read out and execute the program code stored in the storage medium.

In this case, the program code itself read from the storage medium realizes the functions of the present invention, and hence the program code and the storage medium in which the program code is stored constitute the present invention.

Examples of the storage medium for supplying the program code include a flexible disk, a hard disk, a magnetic-optical disk, an optical disk such as a CD-ROM, a CD-R, a CD-RW, a DVD-ROM, a DVD-RAM, a DVD-RW, and a DVD+RW, a magnetic tape, a nonvolatile memory card, and a ROM. Alternatively, the program code may be supplied by downloading from a server computer via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

CROSS REFERENCE TO RELATED APPLICATION

This application claims priority from Japanese Patent Application No. 2004-300254 filed Oct. 14, 2004, which is hereby incorporated by reference herein.

What is claimed is:

1. An image processing result display apparatus comprising:

a first storage device that stores image data;

an image processing device that carries out predetermined image processing on image data;

a display device that displays image data processed by said image processing device in a display layout corresponding to a whole image;

a predicting device that predicts a scrolling direction that will be designated by an operator based on the display layout;

a pre-reading device that pre-reads image data positioned in the scrolling direction predicted by said predicting device, from said first storage device;

a second storage device that stores image data generated by carrying out the predetermined image processing by said image processing device on image data that is pre-read by said pre-reading device;

a reading device that reads a portion of image data displayable by said display device from the image data stored in said first storage device or in said second storage device; and a scrolling device that is operable when image data positioned in the scrolling direction designated by the operator is stored in said second storage device, to cause said reading device to read the image data from said second storage device, generate image data positioned in the scrolling direction designated by the operator, based on the read image data, and causes said display device to display the generated image data; and a determining device that determines whether the display layout is a horizontally elongated configuration or a vertically elongated configuration, wherein said predicting device predicts that the operator will designate scrolling in a horizontal direction when it is determined by said determining device that the display layout has a horizontally elongated configuration, and predicts that the operator will designate scrolling in a vertical direction when it is determined by said determining device that the display layout has a vertically elongated configuration;

wherein a priority order is assigned to the image data pre-read by the pre-reading device;

wherein, when the display layout has a horizontally elongated configuration, image tiles corresponding to the image data pre-read by the pre-reading device adjacent to a right-hand side of an area to be displayed are given priority levels from top to bottom moving rightwards until the right edge of the whole image tiles is reached, then numbering of the priority levels is carried out starting with the left edge of the whole image tiles where the image tiles are numbered from left to right moving downwards, then image tiles positioned one row under the area that is being displayed are numbered from the left edge to the right edge of the whole image tiles, and then numbering continues downwards; and wherein, when the display layout is written vertically, image tiles corresponding to the image data pre-read by the pre-reading device adjacent to the bottom side of the area to be displayed are given priority levels from right to left moving downwards until the bottom edge of the whole image tiles is reached, then numbering of the priority levels is carried out starting with the upper edge of the whole image tiles where the image tiles are numbered from right to left moving downwards, then, after the image tiles on the upper side of the area to be displayed have been numbered, image tiles positioned one column left of the area to be displayed are numbered from the to edge to the bottom edge of the whole image tiles, and then numbering is continued leftwards.

2. An image processing result display apparatus as claimed in claim 1, wherein said second storage device has a faster image data reading speed than that of said first storage device.

3. An image processing result display apparatus as claimed in claim 1, wherein said first storage device stores compressed image data and said image processing device carries out expansion as the predetermined image processing on the compressed image data pre-read from said first storage device.

4. An image processing result display method comprising:

an image processing step of carrying out predetermined image processing on image data;

a display step of displaying image data processed in said image processing step in a display layout corresponding to a whole image;

a predicting step of predicting a scrolling direction that will be designated by an operator based on the display layout;

a pre-reading step of pre-reading image data positioned in the scrolling direction predicted in said predicting step, from a first storage device that stores image data;

a storage step of storing image data generated by carrying out the predetermined image processing in said image processing step on image data that is pre-read in said pre-reading step, in a second storage device;

a reading step of reading a portion of image data displayable on the display in said display step from the image data stored in said first storage device or in said second storage device; and a scrolling step of causing said reading step to read the image data from said second storage device, generating image data positioned in the scrolling direction designated by the operator, based on the read image data, and causing said display step to display the generated image data on the display, when image data positioned in the scrolling direction designated by the operator is stored in said second storage device;

wherein said predicting step includes determining whether the display layout is a horizontally elongated configuration or a vertically elongated configuration, and predicting that the operator will designate scrolling in a horizontal direction when it is determined that the display layout has a horizontally elongated configuration, and predicting that the operator will designate scrolling in a vertical direction when it is determined that the display layout has a vertically elongated configuration;

wherein a priority order is assigned to the image data pre-read by the pre-reading step;

wherein, when the display layout has a horizontally elongated configuration, image tiles corresponding to the image data pre-read by the pre-reading step adjacent to a right-hand side of an area to be displayed are given priority levels from top to bottom moving rightwards until the right edge of the whole image tiles is reached, then numbering of the priority levels is carried out starting with the left edge of the whole image tiles where the image tiles are numbered from left to right moving downwards, then image tiles positioned one row under the area that is being displayed are numbered from the left edge to the right edge of the whole image tiles, and then numbering continues downwards; and wherein, when the display layout is written vertically, image tiles corresponding to the image data pre-read by the pre-reading step adjacent to the bottom side of the area to be displayed are given priority levels from right to left moving downwards until the bottom edge of the whole image tiles is reached, then numbering of the priority levels is carried out starting with the upper edge of the whole image tiles where the image tiles are numbered from right to left moving downwards, then, after the image tiles on the upper side of the area to be displayed have been numbered, image tiles positioned one column left of the area to be displayed are numbered from the top edge to the bottom edge of the whole image tiles, and then numbering is continued leftwards.

5. A computer readable medium encoded with program instructions for causing a computer to execute an image processing result display method, the method comprising:

an image processing step of carrying out predetermined image processing on image data;

a display step of displaying image data processed in said image processing step in a display layout corresponding to a whole image;

a predicting step of predicting a scrolling direction that will be designated by an operator based on the display layout;

a pre-reading step of pre-reading image data positioned in the scrolling direction predicted in said predicting step, from a first storage device that stores image data;

a storage step of storing image data generated by carrying out the predetermined image processing in said image processing step on image data that is pre-read in said pre-reading step, in a second storage device;

a reading step of reading a portion of image data displayable on the display in said display step from the image data stored in said first storage device or in said second storage device; and a scrolling step of causing said reading step to read the image data from said second storage device, generating image data positioned in the scrolling direction designated by the operator, based on the read image data, and causing said display step to display the generated image data on the display, when image data positioned in the scrolling direction designated by the operator is stored in said second storage device;

wherein said predicting step includes determining whether the display layout is a horizontally elongated configuration or a vertically elongated configuration, and predicting that the operator will designate scrolling in a horizontal direction when it is determined that the display layout has a horizontally elongated configuration, and predicting that the operator will designate scrolling in a vertical direction when it is determined that the display layout has a vertically elongated configuration;

wherein a priority order is assigned to the image data pre-read by the pre-reading step;

wherein, when the display layout has a horizontally elongated configuration, image tiles corresponding to the image data pre-read by the pre-reading step adjacent to a right-hand side of an area to be displayed are given priority levels from top to bottom moving rightwards until the right edge of the whole image tiles is reached, then numbering of the priority levels is carried out starting with the left edge of the whole image tiles where the image tiles are numbered from left to right moving downwards, then image tiles positioned one row under the area that is being displayed are numbered from the left edge to the right edge of the whole image tiles, and then numbering continues downwards; and wherein, when the display layout is written vertically, image tiles corresponding to the image data pre-read by the pre-reading step adjacent to the bottom side of the area to be displayed are given priority levels from right to left moving downwards until the bottom edge of the whole image tiles is reached, then numbering of the priority levels is carried out starting with the upper edge of the whole image tiles where the image tiles are numbered from right to left moving downwards, then, after the image tiles on the upper side of the area to be displayed have been numbered, image tiles positioned one column left of the area to be displayed are numbered from the top edge to the bottom edge of the whole image tiles, and then numbering is continued leftwards.

6. An image processing result display method as claimed in claim 4, wherein said second storage device has a faster image data reading speed than that of said first storage device.

7. An image processing result display method as claimed in claim 4, wherein said first storage device stores compressed image data and further comprising a step of carrying out expansion as the predetermined image processing on the compressed image data pre-read from said first storage device.

8. A computer readable medium as claimed in claim 5, wherein said second storage device has a faster image data reading speed than that of said first storage device.

9. A computer readable medium as claimed in claim 5, wherein said first storage device stores compressed image data and further comprising a step of carrying out expansion as the predetermined image processing on the compressed image data pre-read from said first storage device.

* * * * *